United States Patent [19]

Huzii

[11] 4,241,696

[45] Dec. 30, 1980

[54] APPARATUS FOR DETECTING TONER CONCENTRATION

[75] Inventor: Norihito Huzii, Kawasaki, Japan

[73] Assignee: Tokyo Shibaura Denki Kabushiki Kaisha, Kawasaki, Japan

[21] Appl. No.: 29,533

[22] Filed: Apr. 12, 1979

[30] Foreign Application Priority Data

Apr. 19, 1978 [JP] Japan ..... 53-51604[U]

[51] Int. Cl.[3] ..... B05C 19/00; G03G 15/09

[52] U.S. Cl. ..... 118/691; 118/689; 118/690; 118/712; 118/658; 222/DIG. 1; 355/3 DD; 355/14 D

[58] Field of Search ..... 118/689, 690, 691, 712, 118/658; 355/14 D, 3 DD; 222/DIG. 1

[56] References Cited

U.S. PATENT DOCUMENTS

| | | | |
|---|---|---|---|
| 3,318,284 | 5/1967 | Hojo et al. | 118/691 |
| 3,399,652 | 9/1968 | Gawron | 118/691 |
| 3,872,825 | 3/1975 | Davidson | 118/691 |
| 3,897,748 | 8/1975 | Hirata et al. | 118/658 X |
| 4,112,870 | 9/1978 | Extra et al. | 118/691 |

*Primary Examiner*—Shrive P. Beck

*Attorney, Agent, or Firm*—Cushman, Darby & Cushman

[57] ABSTRACT

A toner concentration detecting apparatus comprises a rotatable probe having a toner-receiving face, a case housing the probe, means attached to the case for detecting an amount of toner on the toner-receiving face, and a port formed in the case for discharging stray toner particles from the case. The toner-receiving face is put in contact with a magnetic brush of a developer mechanism, separates toner particles from a developer and receives them. The detecting means includes a light-emitting element for applying light to the toner-receiving face and a light-receiving element for receiving the light reflected by the toner-receiving face and converting the light into an electric signal. The stray toner discharging port extends in the direction in which acts centrifugal force generated by the rotation of the probe and is located near the light-emitting and light-receiving elements.

2 Claims, 2 Drawing Figures

APPARATUS FOR DETECTING TONER CONCENTRATION

BACKGROUND OF THE INVENTION

This invention relates to an apparatus for optically detecting toner concentration in a powdery developer used for an electrophotographic copying apparatus.

In electrophotographic copying process using a powdery developer composed of toner and carrier, the toner particles could deposit in the area that should become a blank portion of an image if the toner content in the developer is too high. This phenomenon is called "fogging". If the toner content is too low, a resultant image is faded to become unfaithful to the original. Fogging and image-fading not only deteriorate image quality but shorten the life of the developer. It is therefore necessary to keep the toner concentration constant. But, since there are various types of originals which differ in toner consumption, it is hardly possible to maintain the toner concentration constant merely by replenishing toner at constant rate.

To solve the problem, various apparatus have been proposed for controlling toner concentration. The apparatus are provided with a detector for detecting toner concentration in a developer electrically, magnetically or optically. The detector produces a detection signal, in accordance with which a proper amount of toner is automatically replenished. An optical toner concentration detector, however, has its sensitivity gradually lowered because toner particles enter it and stick to its light-emitting and light-receiving elements. To have its sensitivity maintained to a satisfactory degree, the optical toner concentration detector should often be cleaned. The cleaning, however, is troublesome and time-consuming.

SUMMARY OF THE INVENTION

An object of this invention is to provide a toner concentration detecting apparatus which is simply constructed and which can yet detect toner concentration to a sufficient degree for a long period of time.

A toner concentration detecting apparatus according to this invention comprises a rotatable probe having a toner-receiving face located in contact with a magnetic brush of a developing mechanism and adapted to separate toner particles from a developer and to receive the same; a case for housing the rotatable probe; means attached to the case for detecting an amount of toner on the toner-receiving face of the probe, said means including a light-emitting element for applying light to the toner-receiving face and a light-receiving element for receiving the light reflected by the toner-receiving face and converting the light into an electric signal; and a stray toner discharging port formed in the case, extending in the direction in which acts the centrifugal force generated by the rotation of the probe and positioned near the light-emitting and light-receiving elements.

DESCRIPTION OF THE PREFERRED EMBODIMENT

Now referring to FIGS. 1 and 2, there will be described a toner concentration detecting apparatus of this invention which constitutes a part of an electrophotographic copying apparatus.

Figure 1:
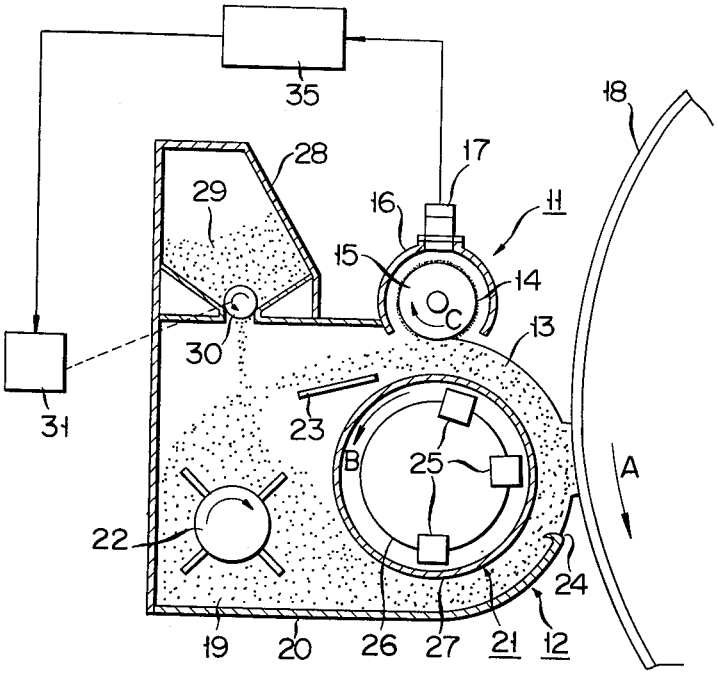
FIG. 1 is a cross sectional view of an electrophotographic copying apparatus provided with a toner concentration detecting apparatus according to this invention.
Figure 2:
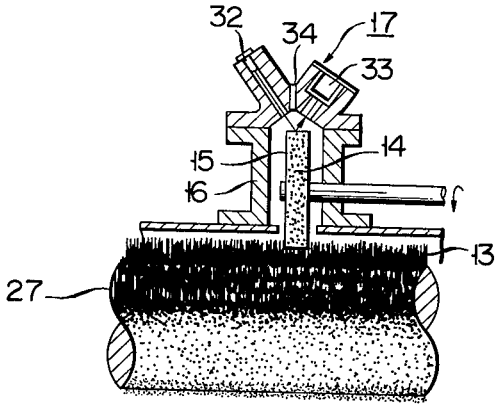
FIG. 2 is an enlarged cross sectional view of the toner concentration detecting apparatus shown in FIG. 1.

As shown in FIG. 1, the toner concentration detecting apparatus 11 is attached to a developing mechanism 12 of an electrophotographic copying apparatus. It comprises a disc-shaped rotatable probe 15 which can be rotated in the direction of arrow C and which has a toner-receiving face 14 in contact with a magnetic brush 13 of the developing mechanism 12. It further comprises a tubular case 16 housing the probe 15, a detector 17 attached to the top of the case 16 for optically detecting an amount of toner on the toner-receiving face 14, and a stray toner discharging port formed in the case 16. The stray toner discharging port will be described hereinlater.

The electrophotographic copying apparatus comprises a photosensitive drum 18 carrying electrostatic latent images and rotating in the direction of arrow A. The developing mechanism 12 comprises a receptacle 20 containing a developer 19, a magnetic brush assembly 21 disposed in the receptacle 20, a mixer 22 for stirring the developer 19, a scraper 23 and a doctor blade 24. The magnetic brush assembly 21 is constituted by a mandrel 26, permanent magnets 25 secured on the periphery of the mandrel 26 and a nonmagnetic sleeve 27 surrounding the mandrel 26 and magnets 25 and rotating in the direction of arrow B, i.e. in the direction opposite to the direction in which the probe 15 rotates.

The magnetic field generated by the permanent magnets 25 on the periphery of the mandrel 26 causes the developer 19 to form a so-called "magnetic brush" around the nonmagnetic sleeve 27. The magnetic brush 13 thus formed rotates in the direction of arrow B as the sleeve 27 rotates.

The developing mechanism 12 further comprises a toner hopper 28, a toner replenishing roller 30 disposed in the hopper 28 and a drive means 31 for rotating the roller 30. The roller 30 is rotated by the drive means 31 thereby to feed toner 29 to the developer receptacle 20.

The rotatable probe 15 is so located that its toner-receiving face 14 is always placed in the magnetic brush 12 to a predetermined depth. The probe 15 is rotated by a drive means (not shown) in the direction of arrow C, i.e. in the direction opposite to the direction in which the magnetic brush 13 rotates. It is made of an electrically conductive and nonmagnetic material such as aluminum. Its periphery or the toner-receiving face 14 has a predetermined reflection factor and attracts toner particles 29 from the developer 19 forming the magnetic brush 13. The optical detector 17 faces the toner-receiving face 14 of the rotatable probe 15. The detector 17 is constituted by, as illustrated in FIG. 2, a light-emitting element 32 such as a light-emitting diode and a light-receiving element 33 such as photodiode. The element 32 applies light to the toner-receiving face 14, and the element 33 receives the light reflected by the toner-receiving face 14 and converts the light into an electric signal.

The electric signal from the light-receiving element 33, i.e. the output signal of the detector 17 is supplied to a control circuit 35 shown in FIG. 1 and amplified. The amplified signal is supplied to, for example, a differential amplifier (not shown) provided in the circuit 35. It is compared with a reference value preset in the differential amplifier. The differential amplifier produces an output signal which represents how much the output signal of the detector 17 differs from the reference value. The output signal of the differential amplifier controls the drive means 31.

The port 34 is formed in the top portion of the case 16 so as to discharge stray toner particles 29 from the case 16. The port 34 extends in the direction in which acts a centrifugal force generated by the rotation of the probe 15 and preferably halfway between the light-emitting element 32 and the light-receiving element 33.

Since the amount of toner 29 usually discharged from the case 16 through the port 34 is extremely small, it is unnecessary to collect it.

Now it will be described how the toner concentration detecting apparatus of the above-mentioned construction operates during the electrophotographic copying process.

When the photosensitive drum 18 carrying electrostatic latent images rotates one time, the sleeve 27 rotates one time, too. Attracted to the magnetic field generated by the permanent magnets 25 on the mandrel 26 inside the sleeve 27, the developer 19 forms a magnetic brush 13 around the sleeve 27. The magnetic brush 13 thus formed rotates in the direction of arrow B as the sleeve 27 rotates. The doctor blade 24 provides the magnetic brush 13 with a thickness which is appropriate to achieve a good developing of electrostatic latent images. The magnetic brush 13 is put into frictional contact with the photosensitive drum 18, thus applying toner 29 to the drum 18 and developing the electrostatic latent images. The developer 19 on the sleeve 27 is removed by the scraper 23 and collected in the receptacle 20. The developer 19 is then stirred by the mixer 22 thoroughly and then forms a magnetic brush 13 again.

Above the sleeve 27 the rotatable probe 15 rotates, contacting the magnetic brush 13. The brush 13, which is rotating in the direction of arrow B, collides with the toner-receiving face 14 of the probe 15 as it moves toward the scraper 23. Then, the toner particles are separated from the carrier though electrostatically attracted to the carrier and then stick to the toner-receiving face 14. The amount of toner 29 on the toner-receiving face 14 is substantially proportional to the toner concentration in the developer 19.

The toner 29 on the toner-receiving face 14 is brought right under the detector 17 as the probe 15 rotates in the direction of arrow C. The light-emitting element 32 of the detector 17 applies light to the toner-receiving face 14. The intensity of the light reflected on the toner-receiving face 14, which varies according to the amount of toner 29 on the toner-receiving face 14, is detected by the light-receiving element 33. The light-receiving element 33 converts the light into an electric signal. The electric signal is supplied to the control circuit 35 and compared by a reference value by the differential amplifier (not shown) provided in the circuit 35. The differential amplifier produces an output signal representing the difference between the reference value and the output signal of the detector 17. The output signal of the differential amplifier controls the drive means 31, which in turn controls the rotation of the toner replenishing roller 30.

Most toner particles on the toner-receiving face 14 are attracted to the charged carrier in the developer 19 when they come into frictional contact with the magnetic brush 13 as the probe 15 further rotates in the direction of arrow C.

Some toner particles from the rotating magnetic brush 13 enter the case 16. These stray toner particles are discharged through the port 34 formed in the case 16. Thus, they would not stick to the light-emitting element 32 or the light-receiving element 33. As a result, the toner concentration detecting apparatus 11 can maintain a sufficient sensitivity for a long period of time. This makes it possible to control the toner concentration in the developer 19 accurately for a long time, without an occasional overhaul of the toner concentration detecting apparatus 12 which is troublesome and time-consuming.

What is claimed is:

1. A toner concentration detecting apparatus comprising a rotatable probe having a toner-receiving face located in contact with a magnetic brush of a developing mechanism and adapted to separate toner particles from a developer and to receive the same; a case housing the rotatable probe; means attached to the case for detecting an amount of toner on the toner-receiving face of the rotatable probe, said means including a light-emitting element for applying light to the toner-receiving face and a light-receiving element for receiving the light reflected by the toner-receiving face and converting the light into an electric signal; and a stray toner discharging port formed in the case, extending in the direction in which acts centrifugal force generated by the rotation of the probe and located near the light-emitting and light-receiving elements and inside said case housing so that stray toner particles are discharged from said case through said port.

2. A toner concentration detecting apparatus according to claim 1, wherein said stray toner discharging port is located halfway between said light-emitting element and said light-receiving element.

* * * * *